United States Patent [19]

Schleiermacher

[11] 4,295,457

[45] Oct. 20, 1981

[54] CRANKCASE VENTILATING DEVICE FOR RECIPROCATING PISTON INTERNAL COMBUSTION ENGINE

[75] Inventor: Herbert Schleiermacher, Brühl, Fed. Rep. of Germany

[73] Assignee: Klöckner-Humboldt-Deutz Aktiengesellschaft, Cologne, Fed. Rep. of Germany

[21] Appl. No.: 74,413

[22] Filed: Sep. 11, 1979

Related U.S. Application Data

[63] Continuation of Ser. No. 845,350, Oct. 25, 1977, abandoned.

[30] Foreign Application Priority Data

Oct. 23, 1976 [DE] Fed. Rep. of Germany ..... 2648112

[51] Int. Cl.[3] ..... F02B 25/06

[52] U.S. Cl. ..... 123/574; 123/41.86

[58] Field of Search ..... 123/117 A, 119 A, 119 B, 123/41.86, 574

[56] References Cited

U.S. PATENT DOCUMENTS

| | | | |
|---|---|---|---|
| 2,775,960 | 1/1957 | Druzynski | 123/119 B |
| 3,145,697 | 8/1964 | Barr et al. | 123/119 B |
| 3,189,012 | 6/1965 | Humphreys | 123/119 B |
| 3,469,565 | 9/1969 | Weber et al. | 123/119 B |
| 3,620,197 | 11/1971 | Albright et al. | 123/41.86 |

FOREIGN PATENT DOCUMENTS

| | | | |
|---|---|---|---|
| 2161050 | 6/1973 | Fed. Rep. of Germany | 123/41.86 |

*Primary Examiner*—Charles J. Myhre
*Assistant Examiner*—W. Wolfe
*Attorney, Agent, or Firm*—Becker & Becker, Inc.

[57] ABSTRACT

A crankcase ventilating device for reciprocating piston internal combustion engines, in which a connecting line between the crankcase and the intake conduit is controlled by a control valve including a spring-loaded control piston, which piston is axially displaceable and has one of its end faces adapted to be actuated upon by the pressure in the crankcase whereas its other end face is adapted to be actuated upon an ambient pressure. The control piston is acted upon by the ambient pressure through a throttle opening ahead of which, when looking in the direction of flow of ambient air through the throttle opening to the control piston, there is arranged a separating chamber having an inlet opening communicating with ambient air.

1 Claim, 1 Drawing Figure

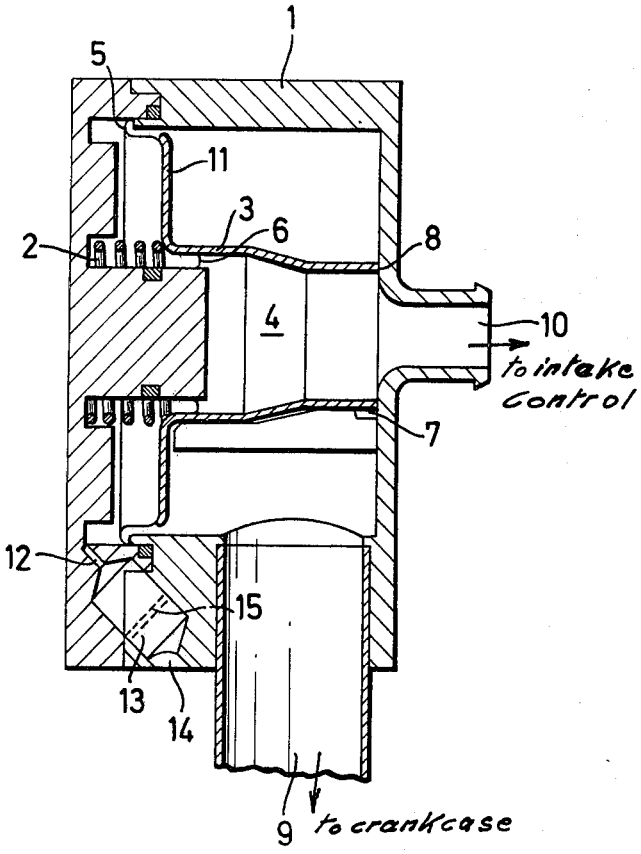
1
5
11
3
6
2
8
4
10
to intake control
7
12
15
13
14
9
to crankcase

CRANKCASE VENTILATING DEVICE FOR RECIPROCATING PISTON INTERNAL COMBUSTION ENGINE

This is a continuation application of parent application Ser. No. 845,350—Schleiermacher filed Oct. 25, 1977, now abandoned.

The present invention relates to a ventilation for a crankcase housing for piston internal combustion engines according to which a connecting line between the crankcase and the intake conduit is controlled by a control valve with a spring loaded control piston axially displaceable in a housing while one end face of said control piston is acted upon by the pressure in the crankcase, and the other end face of said control piston is acted upon by the ambient pressure.

In view of the laws governing ecology, especially the keeping clean of the air, the gases of the crankcase must not any longer be discharged into the open air. Generally they are conveyed to the intake air. In order to obtain a disturbance-free operation of the internal combustion engine, a control valve has to be utilized which controls the pressure in the crankcase independently of the obtained quantity of gas and of the intake underpressure in the intake pipe is controlled to have a constant pressure of approximately from 10 to 25 mm water column.

U.S. Pat. No. 2,080,588 discloses an arrangement in which the connecting line is controlled by a piston connected to a diaphragm. The diaphragm on one side thereof is acted upon by the pressure of the crankcase and on the other side is acted upon by the ambient pressure so that the valve opens as soon as the pressure of the crankcase exceeds the ambient pressure. When the valve has opened, the pressure between the crankcase and the intake conduit equalizes. The total pressure previously acting upon the diaphragm is divided in a dynamic pressure and a static pressure of the flowing gas while only the static pressure acts upon the diaphragm. Therefore, the valve will close prior to the pressure in the crankcase dropping to the environmental pressure. This brings about an unstable control in which the valve during a control operation opens and closes in a pulsating or oscillating manner.

German Gebrauchsmuster No. 70 32 571 discloses a ventilation of a crankcase according to which a control piston is provided with a longitudinal bore and by rolling diaphragms (Rollmembranen) is at the inner and outer circumference connected to a housing, is furthermore guided by webs in axial direction, and on one end face has a closing seat engaging the housing while the covered up area equals the surface inclosed by the effective line of the inner rolling diaphragm. The housing part which is closed off by the closing seat toward the intake line in non-throttled condition communicates with the crankcase. The non-throttled connection between the crankcase and the control piston brings about that also with the closing seat in open position, the actual overpressure in the crankcase in unchanged manner acts upon the control piston. Furthermore, in view of the arrangement of the inner rolling diaphragm and the longitudinal bore in the control piston, the pressure forces in the interior region of the closing seat cancel each other out or act against the housing. As a result thereof, the control piston is acted upon only by the overpressure in the crankcase and by the ambient pressure so that the control is effected independently of the pressure in the intake conduit. When the pressure pulsates or oscillates in the crankcase, there exists the danger that the control piston of the quickly responsive control valve pulsates.

It is, therefore, an object of the present invention, by simple, safe operational means to prevent the control piston from pulsating.

These and other objects of the present invention will appear more clearly from the following specification in connection with the accompanying drawing illustrating a longitudinal section through a ventilation system according to the invention for a crankcase.

The ventilation system according to the invention is characterized primarily in that the control piston is acted upon by the ambient pressure through a throttling area in front of which there is arranged a separating chamber with an inlet opening.

Fundamentally it is known to dampen the movements of control members by throttling areas in a flowing medium. The arrangement of a throttle at the side of the crankcase would be very effective but would affect the control because in view of the reduction in the cross section, the ratio of dynamic pressure relative to the static pressure would change in an unfavorable manner at the control piston when the control valve is open.

In contrast thereto, with the arrangement of the throttling area according to the invention between the surrounding and the control piston, merely the pulsation of the piston is avoided, whereas the control operation itself is not affected because at this area no continuous flow-through exists. In view of the small air volumina which during the actuation of the control piston pass through the throttle areas, it is necessary to keep the throttle area very narrow. This brings about that the throttle area could easily be clogged up by soil particles. This factor is taken into consideration according to the invention by the fact that the throttle area is preceded by a separating chamber with an inlet opening the ambient air quiets down in said separating chamber, and the soil particles are separated without passing into the throttle area itself.

According to a further development of the invention, it is suggested that the intake opening is directed downwardly. In this way it is possible that the separated soil particles drop again toward the outside through the inlet opening. This action with reciprocating piston internal combustion engines is aided by the vibration of the engine housing. The extent to which such separation is effected can be improved by the arrangement of a screen or filter in the separating chamber.

Referring now to the drawing in detail, the arrangement according to the invention comprises a housing 1 of a control valve in which a hollow control piston 3 with a longitudinal cavity or bore 4. The control piston is preloaded by a weak spring 2 which surrounds a projection extending out from an end wall of the housing and into the cavity of the piston. The control piston 3 at its outer and inner circumference is connected by means of rolling diaphragms 5 and 6 relation to the housing 1 and is guided in axial direction by webs 7. At its end face, the control piston 3 forms with the housing 1 a closing seat 8. The connecting conduit to the crankcase not shown in detail is designated with the reference numeral 9. The connecting line to the likewise not illustrated intake conduit is designated with the reference numeral 10. The control surface 11 which pertains to the control piston 3 and which is located opposite the closing seat is acted upon by the ambient pressure through the throttle area 12. Arranged in front of the throttle area 12 is a separating chamber 13 with a screen or filter 15 and a downwardly directed inlet opening 14.

The diaphragm 5 separates the opening defined by the throttle 12 from the opening 9 connected to the crankcase while the diaphragm 6 separates the throttle 12 from the opening 10 connected to the engine air intake. The space between the end wall abutted by the coil spring 2 and the piston forms an ambient air chamber.

It is, of course, to be understood that the present invention is by no means limited to the specific showing in the drawing, but also comprises any modifications within the scope of the appended claims.

What I claim is:

1. A device for ventilating a crankcase of a reciprocating piston, internal combustion engine by connecting the crankcase to the air intake of the engine, the device comprising:

a housing having a first opening in one wall thereof connected to the crankcase, a downwardly extending second opening communicating with ambient air, and a third opening in a first end wall of the housing connected to the air intake and disposed substantially normal to the first opening;

a piston mounted in the housing, the piston having a cavity therein which faces and surrounds the third opening and which extends normally with respect to the first opening; whereby when the piston reciprocates in a direction normal to the first opening, the third opening is uncovered allowing vapor to flow from the first opening through the housing and out of the third opening;

a projection mounted on a second end wall of the housing opposite the third opening and extending into the cavity of the piston, the projection having a diameter substantially less than the inner diameter of the cavity;

a coil spring surrounding the projection and abutting the piston at one end and the second end wall at the other end for urging the piston to close the third opening;

a first diaphragm disposed between the piston and said one wall of the housing at a location between the first and second openings to seal the first opening from the second opening;

a second diaphragm disposed between the surface of the cavity in the piston and the projection to effect a seal between the second opening and third opening, wherein the first and second diaphragms cooperate with the second end wall to form an ambient air chamber isolated from the first and third openings, the ambient air chamber communicating with the atmosphere via the second opening, whereby when pressure in the housing between the first and third openings exceeds ambient air pressure the piston compresses the coil spring and opens communication between the first and second openings;

a relatively narrow inlet communicating directly with the ambient air chamber and the second opening for throttling ambient air entering the ambient air chamber, and a separating chamber communicating with the narrow inlet and being relatively wide with respect to the narrow inlet, said separating chamber including a downwardly facing screen extending thereacross for filtering out dirt in the ambient air and a downwardly facing outlet through which the ambient air enters and the filtered dirt drops.

* * * * *